US006350163B1

(12) United States Patent
Fujimoto

(10) Patent No.: US 6,350,163 B1
(45) Date of Patent: Feb. 26, 2002

(54) JET PROPULSION BOAT

(75) Inventor: Katsumi Fujimoto, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/534,361

(22) Filed: Mar. 24, 2000

(30) Foreign Application Priority Data

Mar. 26, 1999 (JP) ..... 11-084784

(51) Int. Cl.[7] ..... B63H 11/11

(52) U.S. Cl. ..... 440/1; 440/41

(58) Field of Search ..... 440/1, 41

(56) References Cited

U.S. PATENT DOCUMENTS 5,755,601 A * 5/1998 Jones ..... 440/41

FOREIGN PATENT DOCUMENTS

JP A6156379 6/1994
JP 7-187083-a * 7/1995

* cited by examiner

*Primary Examiner*—Sherman Basinger

(57) ABSTRACT

The invention is an operating system for a fuel cell power plant that includes at least one fuel cell for producing electrical energy from a reducing and oxidant fluid and fuel processing components including a reformer and a burner for processing a hydrocarbon fuel into the reducing fluid, and a direct mass and heat transfer device secured in fluid communication with both a process oxidant stream and a plant exhaust passage, so that the device directly transfers mass such as water exiting the plant in a plant exhaust stream back into the plant within the process oxidant stream. The invention also includes a split oxidant passage that directs the process oxidant stream through the fuel cell and a reformer feed portion of the process oxidant stream into fluid communication with the fuel processing components. The system may also include an anode exhaust passage that directs an anode exhaust from the fuel cell into the burner, then directs the oxidized anode exhaust stream from the burner in heat exchange relationship with the reformer feed portion.

18 Claims, 7 Drawing Sheets

JET PROPULSION BOAT

BACKGROUND OF THE INVENTION

1. Field of the Invention

The present invention relates to a jet propulsion boat which moves ahead or astern by jetting water sucked from an opening in a boat's bottom in a backward direction.

2. Description of Background Art

A known jet propulsion boat of a type operated in a manner similar to that for a motorcycle is configured as follows. A driver sitting astride a seat holds the steering handlebar with both hands to operate the boat to go ahead by actuating an accelerator lever at the right end of the steering handlebar. The operator makes the boat go astern or slow down by operating an operating lever at the left end of the steering handle.

A jet propulsion boat of this type has been proposed, for example, in Japanese Patent Laid-open No. Hei 6-156379. The technique disclosed in this document will be briefly described with reference to FIG. 8.

FIG. 8 is a view illustrating the above-described prior art jet propulsion boat. Referring to FIG. 8, the jet propulsion boat designated by reference numeral 100 includes an operating lever 104 mounted on a left grip 102 of a steering handlebar 101; an accelerator lever 105 mounted on a right grip 103 of the steering handlebar 101; a water jetting nozzle 106 mounted at a stem of the jet propulsion boat 100; and a going-astern bucket 108 mounted to the nozzle 106.

An operational procedure for making the jet propulsion boat 100 go astern will be described below.

First, the operating lever 104 is operated in the direction shown by an arrow "a" to move the bucket 108 in the direction shown by an arrow "b" up to a position facing to the outlet of the nozzle 106. Then, the accelerator lever 105 is operated in the direction shown by an arrow "c" while operating the lever 104, to increase the engine speed.

As the engine speed is increased, an impeller (not shown) is rotated at a high speed, to jet water backward from the nozzle 106. At this time, the direction of the water thus jetted is reversed as shown by an arrow "d" by means of the bucket 108. In this way, since the water is jetted forward of the jet propulsion boat 100, the jet propulsion boat 100 goes astern.

The prior art jet propulsion boat, however, has the following problem: namely, in the going-astern mode, a driver requires two operations, that is, the operation of the left operating lever 104 with the left hand and the operation of the accelerator lever 105 with the right hand. Since the driver must simultaneously perform the two-operations with both hands, he must shoulder a relatively large burden. In this regard, it has been desired to develop a jet propulsion boat excellent in operability.

SUMMARY AND OBJECTS OF THE INVENTION

An object of the present invention is to provide a technique capable of improving the operability of a jet propulsion boat.

To solve the above-described problem, according to the present invention, there is provided a jet propulsion boat which moves ahead, in a forward mode, by jetting backward water sucked from an opening in a boat's bottom through a nozzle, and which goes astern or slows down, in a going-asten/slowing-down mode, by shifting a water reversing cup to a position facing to the outlet of the nozzle and reversing the water jetting direction by means of the cup, the jet propulsion boat including: a transmission mechanism for transmitting a force to drive the water reversing cup; an operating piece for pushing/withdrawing the transmission mechanism; an operating force measuring means for measuring an operating force applied to the operating piece, the operating force measuring means being provided on the transmission mechanism or the operating piece; and a propulsion force control means for controlling a water jetting force on the basis of the operating force measured by the operating force measuring means.

With this configuration, the water jetting force can be controlled on the basis of the operating force by operating the operating piece to shift the water reversing cup to the position facing to the outlet of the nozzle and further increasing the operating force applied to the operating piece.

Accordingly, two-stage operations, that is, the operation to shift the water reversing cup to the position facing to the outlet of the nozzle and the operation to control the water jetting force can be performed by operating only one operating piece. As a result, the going-astern operation or the slowing-down operation of the jet propulsion boat can be performed by one hand or one foot.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
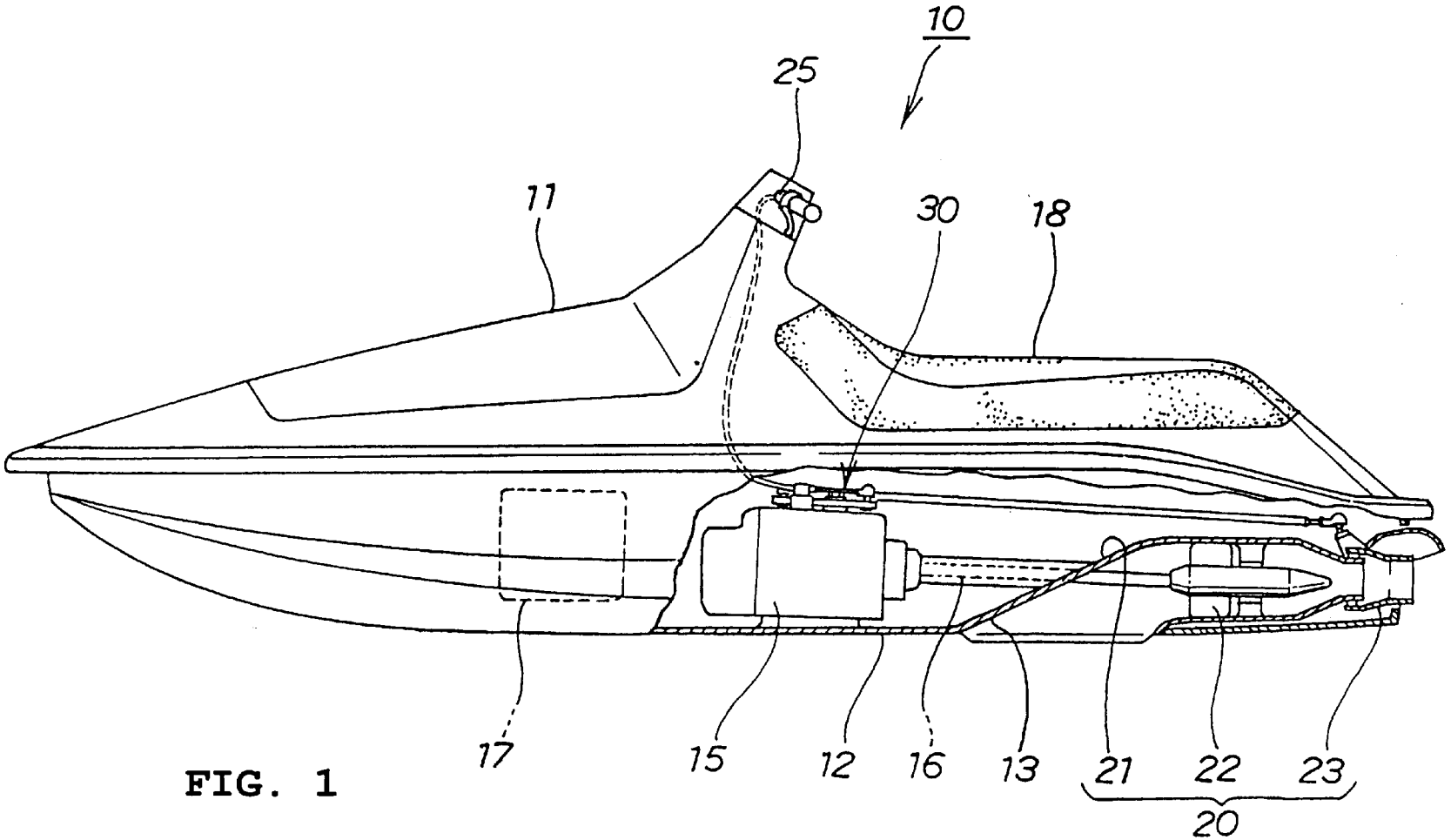
FIG. 1 is a side view of a jet propulsion boat according to a first embodiment of the present invention.

Hereinafter, embodiments of the present invention will be described with reference to the accompanying drawings. FIG. 1 is a side view of a jet propulsion boat according to a first embodiment of the present invention wherein a jet propulsion boat 10 includes an engine 15 mounted at an approximately central portion of a hull 11; a jet propulsion machine 20 driven by the engine 15 for jetting water, which is sucked from an opening 13 formed in the boat's bottom 12, backward of the hull 11; a steering handlebar 25 for controlling the turning direction of the hull 11; and a going-astern/slowing-down means 30 for allowing the hull 11 to go astern or slow down by reversing the water jetting direction. A fuel tank 17 is mounted below a seat 18.

The jet propulsion machine 20 includes a housing 21 extending backwards from the opening 13 of the boat's bottom 12; an impeller 22 rotatably mounted in the housing 21 and connected to a drive shaft 16 of the engine 15; and a nozzle 23 mounted at the rear end of the housing 21 in such a manner as to be swingable in the turning direction of the hull 11. The jet propulsion machine 20 generates a jet propulsion force by rotating the impeller 22 for sucking water from the opening 13 of the boat's bottom 12 and jetting the sucked water backward of the hull 11 through the nozzle 23.

Figure 2:
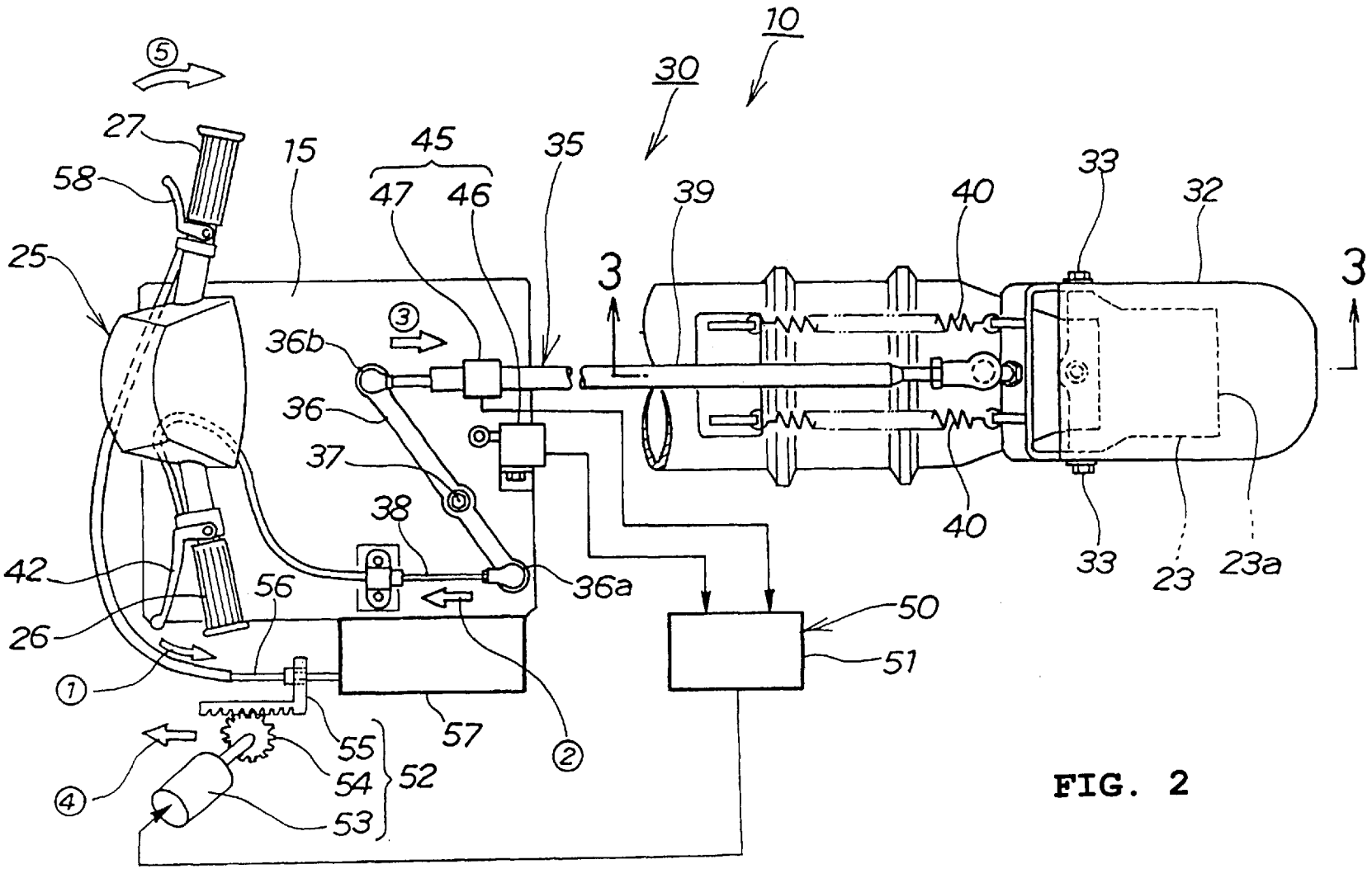
FIG. 2 is a plan view of the jet propulsion boat according to the first embodiment of the present invention.

FIG. 2 is a plan view of the jet propulsion boat according to the first embodiment of the present invention. The steering handlebar 25 is rotatably mounted at an approximately central portion of the boat body 11 (see FIG. 1). When the steering handlebar 25 is turned to the right or left by a driver holding the right and left grips 26 and 27, the jet propulsion boat 10 is turned to the right or left.

The going-astern/slowing-down means 30 includes a water reversing cup 32 vertically swingably mounted to the nozzle 23 with bolts 33; a link mechanism 35 as a transmission mechanism for shifting the water reversing cup 32 between a position over the nozzle 23 and a position behind the nozzle 23 (that is, a position facing an outlet 23*a* of the nozzle 23); a going-astern/slowing-down lever 42 as an operating piece for pushing/withdrawing the link mechanism 35; an operating force measuring means 45, provided on the link mechanism 35, for measuring an operating force applied to the going-astern/slowing-down lever 42; and a propulsion force control means 50 for controlling a water jetting force on the basis of the operating force measured by the operating force measuring means 45.

The link mechanism 35 has a link 36 rotatably mounted to the engine 15 with a bolt 37, wherein one end 36*a* of the link 36 is connected to the going-astern/slowing-down lever 42 with a wire 38, and the other end 36*b* of the link 36 is connected to the water reversing cup 32 with a rod 39. When the going-astern/slowing-down lever 42 is operated as shown by an arrow (1), the one end 36*a* of the link 36 is withdrawn via the wire 38 in the direction shown by an arrow (2) to turn the link 36 around the bolt 37, and thereby the other end 36*b* of the link 36 is turned around the bolt 37 to push the rod 39 in the direction shown by an arrow (3), thereby shifting the water reversing cup 32 at the position facing to the outlet 23*a* of the nozzle 23.

When the operating force applied to the going-astern/slowing-down lever 42 is released, the water reversing cup 32 is returned to the position over the nozzle 23 by a spring force of two return springs 40. At the same time, the going-astern/slowing-down lever 42 is returned to the original state by a spring force of a lever returning spring (not shown).

The going-astern/slowing-down lever 42 is swingably mounted on the left grip 26 of the steering handlebar 25, and as described above, the lever 42 is operated in the direction shown by the arrow (1) to withdraw the one end 36*a* of the link 36 via the wire 38 in the direction shown by the arrow (2).

The operating force sensor means 45 includes a position detecting sensor 46 and an operating force measuring sensor 47. The position detecting sensor 46 is mounted near the link 36. When the water reversing cup 32 is shifted to the position facing to the outlet 23*a* of the nozzle 23, the link 36 is brought into contact with the position detecting sensor 46. In this way, the position detecting sensor 46 detects the going-astern/slowing-down mode. The operating force measuring sensor 47 is mounted on the way of the rod 39 for measuring an operating force applied to the rod 39 (that is, a force pushing the rod 39).

The use of the position detecting sensor 46 has the following advantage; namely, if the water reversing cup 32 is caught by some foreign matter and locked before it reaches the position facing to the outlet 23*a* of the nozzle 23, no signal is supplied from the position detecting sensor 46 to the propulsion force control means 50 although a signal is supplied from the operating force measuring sensor 47 to the propulsion force control means 50, with a result that the propulsion force control means 50 does not carry out the control of the water jetting force on the basis of the operating force measured by the operating force measuring sensor 47.

The propulsion force control means 50 includes a control unit 51. When receiving a going-astern/slowing-down mode signal from the position detecting sensor 46 and an operating force measuring signal from the operating force measuring sensor 47, the control unit 51 supplies a signal corresponding to the magnitude of the operating force measuring signal (that is, the degree of the operating force) to a drive unit 52. On the basis of the signal supplied from the control unit 51, the drive unit 52 is operated such that a rack 55 is moved in the direction shown by an arrow (4) by rotating a pinion 54 with a motor 53 to withdraw a wire 56 for adjusting the opening degree of a throttle valve 57 thereby controlling the water jetting force.

The wire 56 is connected to an accelerator lever 58, and therefore, the throttle valve 57 can be withdrawn in the opening direction by operating the accelerator lever 58 in the direction shown by an arrow (5).

Figure 3:
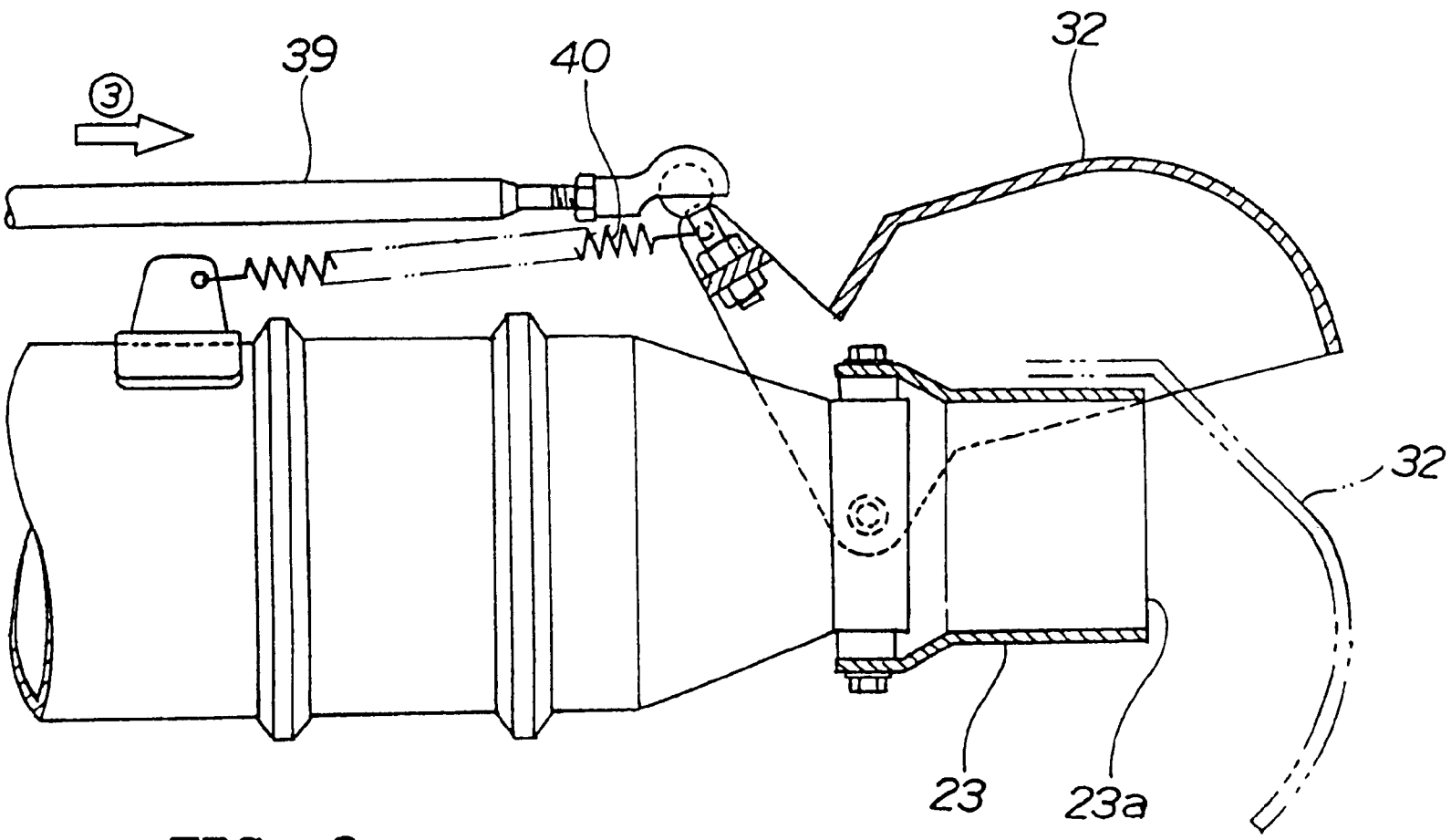
FIG. 3 is a sectional view taken on line 3—3 of FIG. 2.

FIG. 3 is a sectional view taken on line 3—3 of FIG. 2, showing a state in which the water reversing cup 32 is returned to the position over the nozzle 23 by the spring force of the return springs 40.

At this time, since the water reversing cup 32 is moved to a position higher than the outlet 23*a* of the nozzle 23, water jetted from the outlet 23*a* of the nozzle 23 does not collide against the water reversing cup 32, and accordingly, the water can be jetted backward from the outlet 23*a* of the nozzle 23.

When the water reversing cup 32 is shifted to the position facing to the outlet 23*a* of the nozzle 23 as shown by an imaginary line in FIG. 3, the water jetting direction is reversed by means of the water reversing cup 32.

The function of the jet propulsion boat 10 configured as described above will be described below.

Figure 4A:
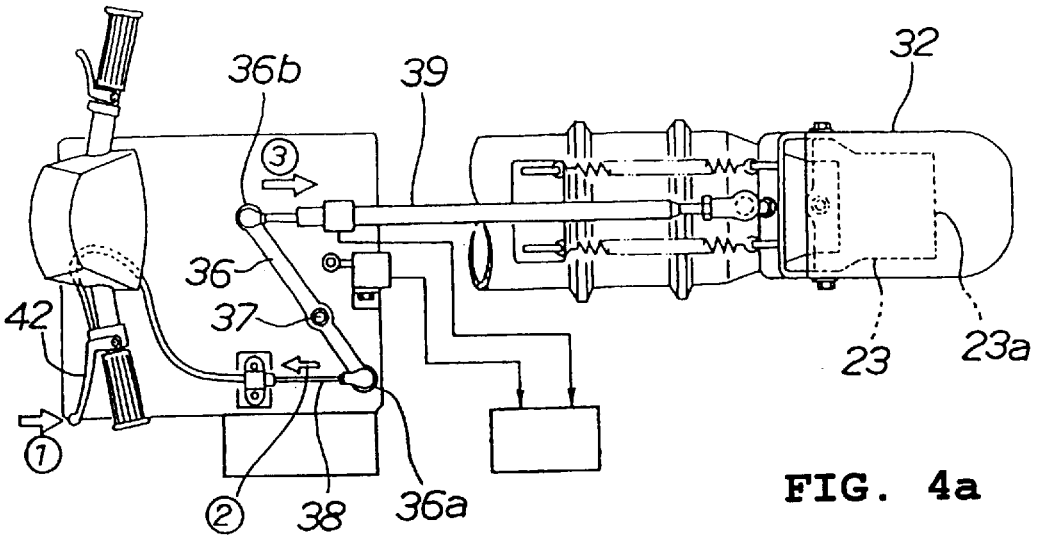
FIGS. 4(*a*) and 4(*b*) are views illustrating a first function of the jet propulsion boat according to the first embodiment of the present invention.
Figure 4B:
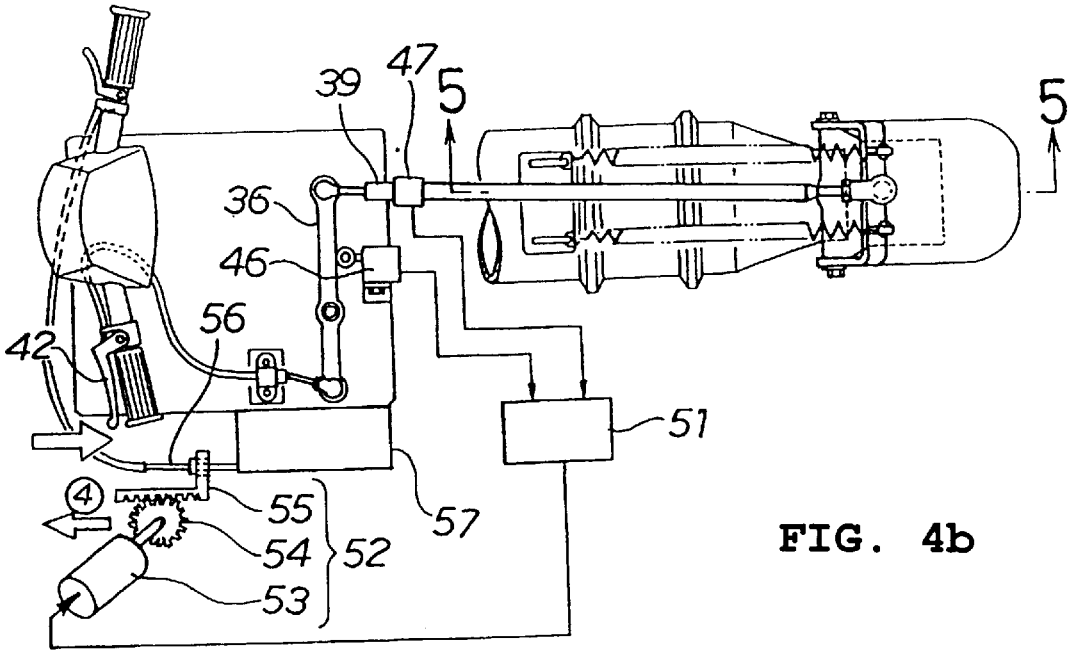

FIGS. 4(*a*) and 4(*b*) are views illustrating a first function of the jet propulsion boat according to the first embodiment of the present invention. Referring to FIG. 4(*a*), when the going-astern/slowing-down lever 42 is operated in the direction shown by the arrow (1), the one end 36*a* of the link 36 is withdrawn via the wire 38 in the direction shown by the arrow (2) to turn the link 36 around the bolt 37, so that the other end 36*b* of the link 36 is turned around the bolt 37 to push the rod 39 in the direction shown by the arrow (3), thereby shifting the water reversing cup 32 to the position facing to the outlet 23*a* of the nozzle 23.

Referring to FIG. 4(*b*), when the link 36 is brought into contact with the position detecting sensor 46, the sensor 46 detects the going-astern/slowing-down mode. In such a state, the operating force applied to the going-astern/slowing-down lever 42 is further increased to apply an operating force to the rod 39. The operating force applied to the rod 39 is measured by the operating force measuring sensor 47.

When receiving a going-astern/slowing-down mode signal detected by the position detecting sensor 46 and an operating force measuring signal detected by the operating force measuring sensor 47, the control unit 51 supplies a signal corresponding to the magnitude of the operating force measuring signal (that is, the degree of the operating force) to the drive unit 52. On the basis of the signal supplied from the control unit 51, the drive unit 52 is operated such that the rack 55 is moved in the direction shown by the arrow (4) by rotating the pinion 54 with the motor 53 to withdraw the wire 56 for adjusting the opening degree of the throttle valve 57 thereby increasing the engine speed.

Figure 5:
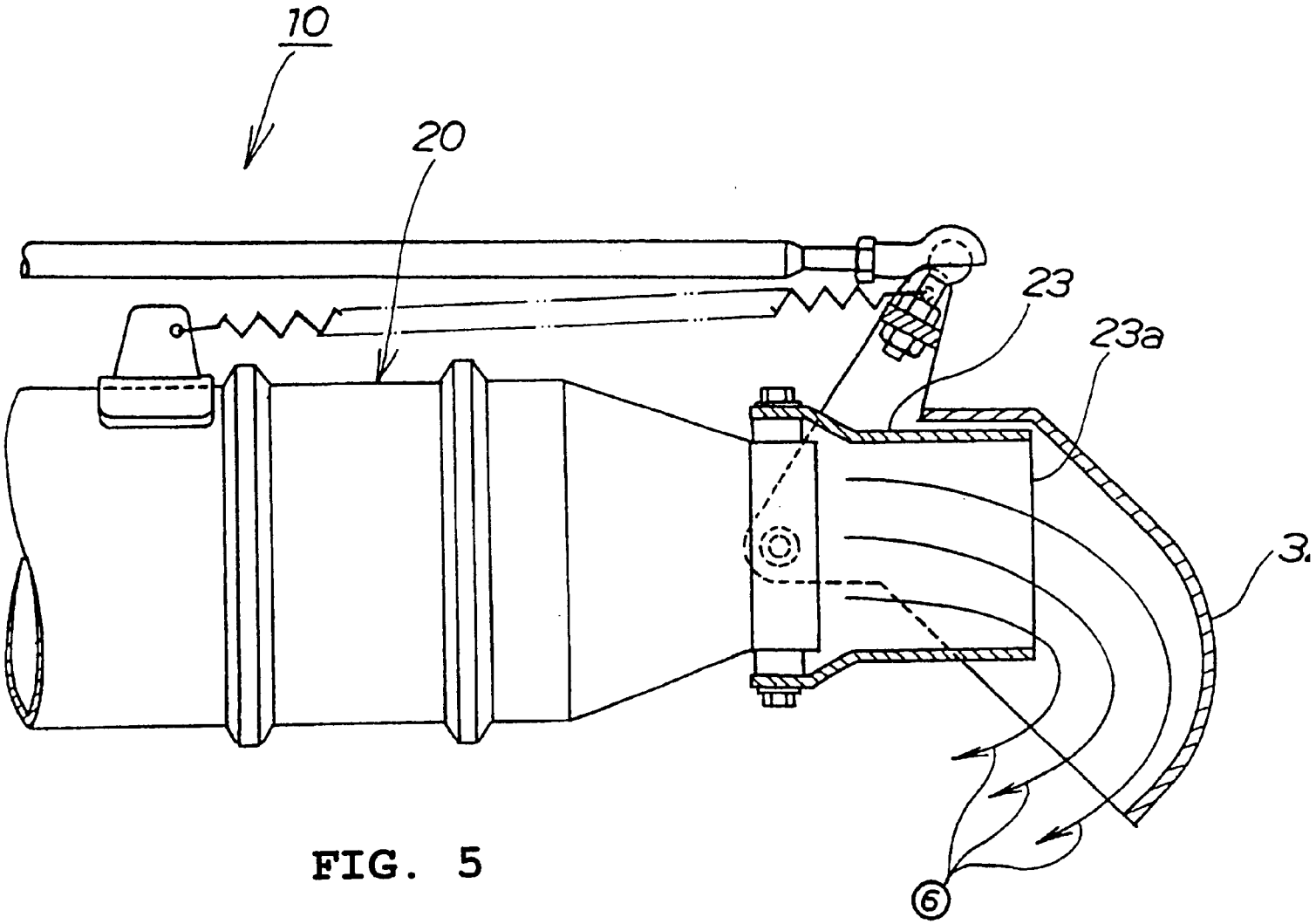
FIG. 5 is a view illustrating a second function of the jet propulsion boat according to the first embodiment of the present invention.

FIG. 5 is a view illustrating a second function of the jet propulsion boat according to the first embodiment of the present invention. As the engine speed is increased, the impeller 22 of the jet propulsion machine 20 (see FIG. 1) is rotated at a high speed, whereby water is jetted backward from the outlet 23*a* of the nozzle 23. The jet propulsion boat 10 is thus allowed to go astern by reversing the streams of the jetted water in the directions shown by arrows (6) by means of the water reversing cup 32.

In this way, the driver can control the water jetting force on the basis of the operating force by operating the going-asten/slowing-down lever 42 with one hand to shift the water reversing cup 32 to the position facing to the outlet 23*a* of the nozzle 23 and further increasing the operating force applied to the going-astern/slowing-down lever 42.

In other words, two-stage operations, that is, the operation to shift the water reversing cup 32 to the position facing to the outlet 23*a* of the nozzle 23 and the operation to control the water jetting force can be performed only by operating the going-asten/slowing-down lever 42.

Figure 6:
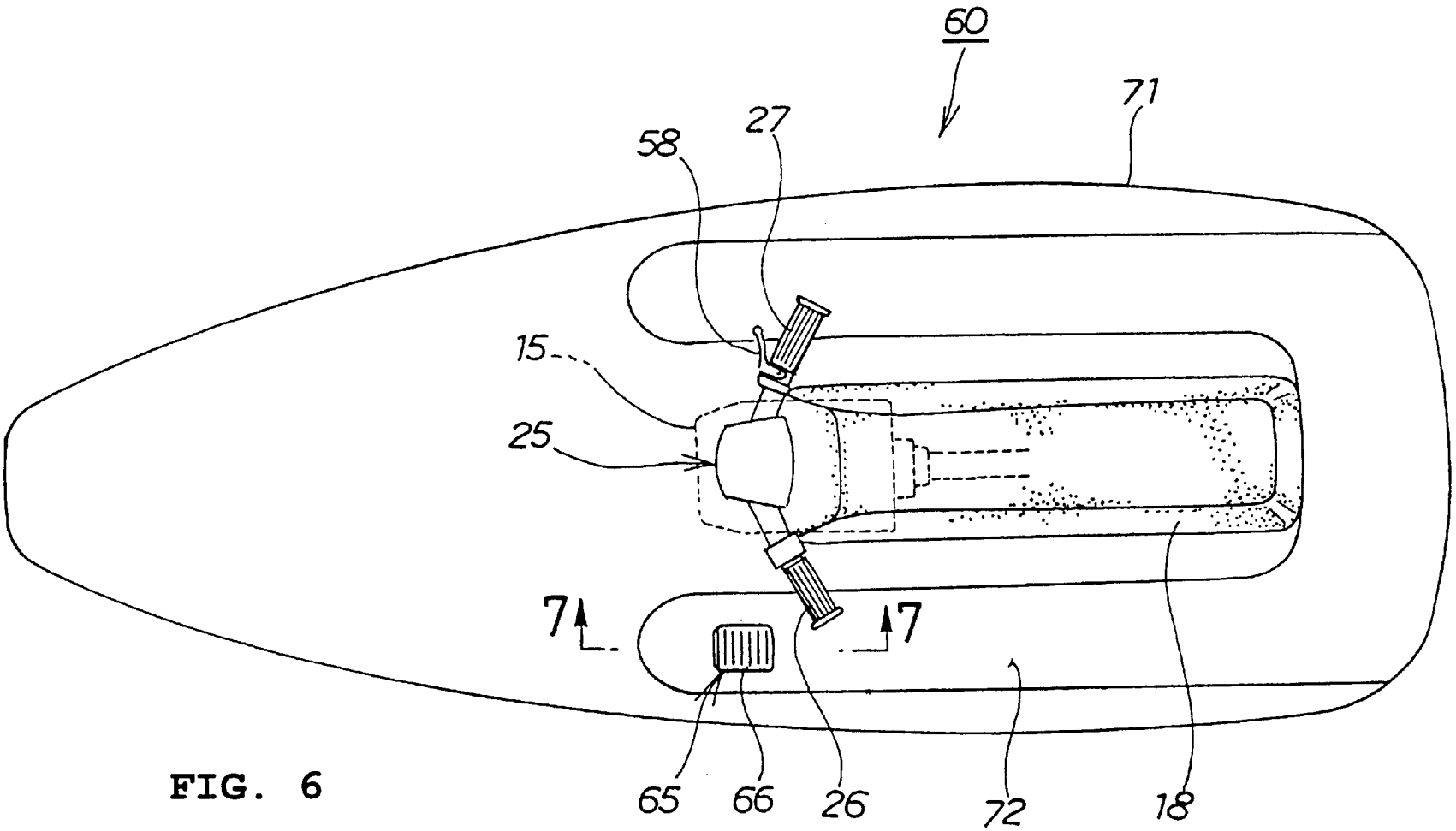
FIG. 6 is a plan view of a jet propulsion boat according to a second embodiment of the present invention.

A second embodiment will be described with reference to FIGS. 6 and 7. In this embodiment, the same members as those in the first embodiment are designated by the same characters, and the overlapped description thereof is omitted. FIG. 6 is a plan view of a jet propulsion boat according to a second embodiment of the present invention.

Referring to FIG. 6, a jet propulsion boat 60 is configured such that the going-astern/slowing-down lever 42 of the going-astern/slowing means 30 adopted in the first embodiment is replaced with a going-astern/slowing-down pedal 66 (operating piece) of a going-astern/slowing-down means 65, which is mounted on a left floor portion 72 of a hull 71.

The going-astern/slowing-down means 65 includes a link mechanism, an operating force measuring means and a propulsion force control means having the same configurations as those of the link mechanism 35, operating force measuring means 45 and propulsion force control means 50 in the first embodiment, respectively.

Figure 7:
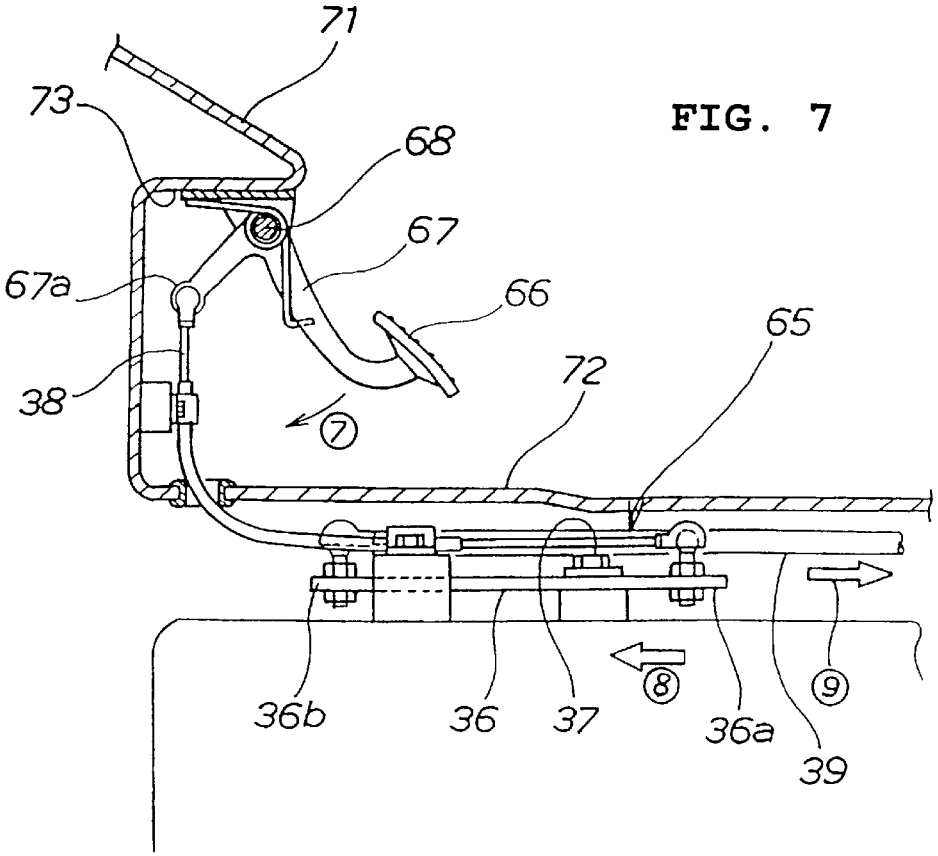
FIG. 7 is a sectional view taken on line 7—7 of FIG. 6.
Figure 8:
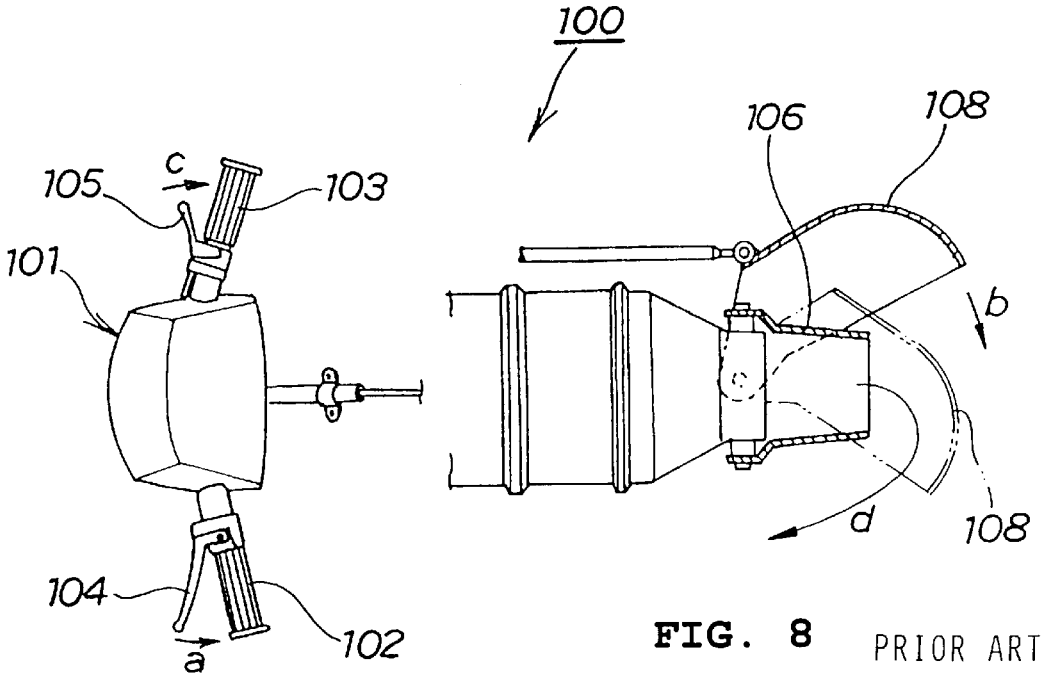
FIG. 8 PRIOR ART
FIG. 8 is a view illustrating a prior art jet propulsion boat.

FIG. 7 is a sectional view taken on line 7—7 of FIG. 6. The going-astern/slowing-down pedal 66 has an approximately L-shaped arm 67 rotatably mounted on a recessed upper surface 73 of the left floor portion 72 with a pin 68. A tip 67*a* of the arm 67 is connected to one end 36*a* of a link 36 by means of a wire 38.

Accordingly, when the going-astern/slowing-down pedal 66 is depressed in the direction shown by an arrow (7), the one end 36*a* of the link 36 is withdrawn via the wire 38 in the direction shown by an arrow (8) to turn the link 37 around a bolt 37, and thereby the other end 36*b* of the link 36 is turned around the bolt 37 to push a rod 39 in the direction shown by an arrow (9), thereby shifting a water reversing cup to a position facing to the outlet of a nozzle like the first embodiment.

After that, like the first embodiment, by increasing the depressed force (operating force) of the going-asten/slowing-down pedal 66 to adjust the opening degree of a throttle valve, the engine speed is increased to rotate an impeller of a jet propulsion machine at a high speed, thereby controlling the jetting force of water jetted backward by the jet propulsion machine. On the other hand, the jet propulsion boat is allowed to go astern by reversing the water jetting direction by means of the water reversing cup.

In this way, the driver can control the water jetting force on the basis of the operating force by operating the going-astern/slowing-down pedal 66 with one foot to shift the water reversing cup to the position facing to the outlet of the nozzle and further increasing the operating force applied to the going-astern/slowing-down pedal 66.

In other words, two-stage operations, that is, the operation to shift the water reversing cup to the position facing to the outlet of the nozzle and the operation to control the water jetting force can be performed only by operating the going-astern/slowing-down pedal 66.

In the embodiments, description has been made by way of the example in which the going-astern/slowing-down means 30 (or 65) is used in the going-astern mode; however, the going-astern/slowing-down means 30 (or 65) can be driven during the going-ahead operation of the jet propulsion boat 10 (or 60). By driving the going-astern/slowing-down means 30 (or 65) during the going-ahead operation of the jet propulsion boat 10 (or 60), it is possible to efficiently slow down the jet propulsion boat 10 (or 60).

While the position detecting sensor 46 and the operating force measuring sensor 47 are mounted in the embodiments, only the operating force measuring sensor 47 may be mounted.

In the embodiments, the operating force measuring sensor 47 is mounted on the rod of the link mechanism 35; however, it may be mounted on the going-astern/slowing-down lever 42 or the going-astern/slowing-down pedal 66 with the same effect.

Although the going-astern/slowing-down pedal 66 is mounted on the left floor portion 72 of the hull 71 in the second embodiment, it may be mounted on a right floor portion of the hull 71.

The present invention configured as described above exhibits the following effects:

The present invention is configured such that an operating force is measured by the operating force measuring means and the water jetting force is controlled on the basis of the operating force thus measured. Accordingly, it is possible to control the water jetting force on the basis of the operating force by operating the operating piece to shift the water reversing cup to the position facing to the outlet of the nozzle and further increasing the operating force applied to the operating piece.

As a result, two-stage operations, that is, the operation to shift the water reversing cup to the position facing to the outlet of the nozzle and the operation to control the water jetting force can be performed by operating only one operating piece.

Accordingly, since the going-astern operation or the slowing-down operation of the jet propulsion boat can be performed by one hand or one foot, it is possible to simplify the operation of the jet propulsion boat, that is, improve the operability of the jet propulsion boat.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A jet propulsion boat for moving ahead, in a going-ahead mode, by jetting backward water sucked from an opening in a boat's bottom through a nozzle, and which goes astern or slows down, in a going-astern/slowing-down mode, by shifting a water reversing cup to a position facing to an outlet of said nozzle and reversing the water jetting direction by means of said cup, said jet propulsion boat comprising:

a transmission mechanism for transmitting a force to drive a water reversing cup;

an operating piece for pushing/withdrawing said transmission mechanism;

an operating force sensor means for measuring an operating force applied to said operating piece, said operating force sensor means being provided on said transmission mechanism or said operating piece; and a propulsion force controlling device for controlling a water jetting force on the basis of the operating force measured by said operating force sensor means.

2. The jet propulsion boat according to claim 1, wherein said transmission mechanism includes a link mechanism having a first end operatively connected to said water reversing cup and a second end operatively connected to a link, said link being connected to said operating piece for selectively imparting movement thereto.

3. The jet propulsion boat according to claim 2, wherein said link includes a first end operatively connected to said link mechanism and a second end operatively connected to said operating piece, an intermediate portion of said link being pivotably mounted relative to said jet propulsion boat.

4. The jet propulsion boat according to claim 1, wherein said operating force sensor means is operatively connected to said transmission mechanism, said operating force sensor means includes a position detecting sensor and an operating force measuring sensor for transmitting signals to said propulsion force control device for controlling the water jetting force.

5. The jet propulsion boat according to claim 1, and further including a drive unit operatively connected to said propulsion force control device for controlling the water jetting force.

6. The jet propulsion boat according to claim 1, wherein said operating piece is hand actuated.

7. A control mechanism for controlling a water jetting force of a jet propulsion boat comprising:

a transmission mechanism for transmitting a force to drive a water reversing cup operatively positioned relative to a water discharge area of said jet propulsion boat;

an operating piece for imparting movement to said transmission mechanism;

an operating force sensor means for measuring an operating force applied to said operating piece, said operating force sensor means being operatively mounted relative to said transmission mechanism; and a propulsion force control device for controlling a water jetting force on the basis of the operating force measured by said operating force sensor means.

8. The control mechanism according to claim 7, wherein said transmission mechanism includes a link mechanism having a first end operatively connected to said water reversing cup and a second end operatively connected to a link, said link being connected to said operating piece for selectively imparting movement thereto.

9. The control mechanism according to claim 8, wherein said link includes a first end operatively connected to said link mechanism and a second end operatively connected to said operating piece, an intermediate portion of said link being pivotably mounted relative to said jet propulsion boat.

10. The control mechanism according to claim 7, wherein said operating force sensor means is operatively connected to said transmission mechanism, said operating force sensor means includes a position detecting sensor and an operating force measuring sensor for transmitting signals to said propulsion force control device for controlling the water jetting force.

11. The control mechanism according to claim 7, and further including a drive unit operatively connected to said propulsion force control device for controlling the water jetting force.

12. The control mechanism according to claim 7, wherein said operating piece is hand actuated.

13. A control mechanism for controlling a water jetting force of a jet propulsion boat comprising:

a transmission mechanism for transmitting a force to drive a water reversing cup operatively positioned relative to a water discharge area of said jet propulsion boat;

an operating piece for imparting movement to said transmission mechanism;

an operating force sensor means for measuring an operating force applied to said operating piece, said operating force sensor means being operatively mounted relative to said operating piece; and a propulsion force control device for controlling a water jetting force on the basis of the operating force measured by said operating force sensor means.

14. The control mechanism according to claim 13, wherein said transmission mechanism includes a link mechanism having a first end operatively connected to said water reversing cup and a second end operatively connected to a link, said link being connected to said operating piece for selectively imparting movement thereto.

15. The control mechanism according to claim 14, wherein said link includes a first end operatively connected to said link mechanism and a second end operatively connected to said operating piece, an intermediate portion of said link being pivotably mounted relative to said jet propulsion boat.

16. The control mechanism according to claim 13, wherein said operating force sensor means is operatively connected to said transmission mechanism, said operating force sensor means includes a position detecting sensor and an operating force measuring sensor for transmitting signals to said propulsion force control device for controlling the water jetting force.

17. The control mechanism according to claim 13, and further including a drive unit operatively connected to said propulsion force control device for controlling the water jetting force.

18. The control mechanism according to claim 13, wherein said operating piece is hand actuated.

* * * * *

UNITED STATES PATENT AND TRADEMARK OFFICE

CERTIFICATE OF CORRECTION

PATENT NO. : 6,350,163 B1
DATED : February 26, 2002
INVENTOR(S) : Katsumi Fujimoto It is certified that error appears in the above-identified patent and that said Letters Patent is hereby corrected as shown below:

Title page,
Item [57], ABSTRACT, please replace the current ABSTRACT with the following correct ABSTRACT:

-- [57] ABSTRACT

A jet propulsion boat includes a link mechanism for driving a water reversing cup; a going-astern/slowing-down lever for pushing/withdrawing the link mechanism; an operating force measuring member for measuring an operating force applied to the going-stern/slowing-down lever, which is provided on the link mechanism or going-astern/slowing-down lever; and a propulsion force control member for controlling a water jetting force on the basis of the operating force measured by the operating force measuring member. Accordingly, the two-stage operations, that is, the operation to shift the water reversing cup to the position facing to the outlet of the nozzle and the operation to control the water jetting force can be performed only by operating the going-astern/slowing-down lever. --

Signed and Sealed this

Eighteenth Day of February, 2003

JAMES E. ROGAN
*Director of the United States Patent and Trademark Office*